United States Patent [19]

Miller, Jr. et al.

[11] 4,047,678

[45] Sept. 13, 1977

[54] MODULATED, DUAL FREQUENCY, OPTICAL TRACKING LINK FOR A COMMAND GUIDANCE MISSILE SYSTEM

[75] Inventors: Walter E. Miller, Jr.; Jimmy R. Duke; Robert L. Sitton, all of Huntsville, Ala.

[73] Assignee: The United States of America as represented by the Secretary of the Army, Washington, D.C.

[21] Appl. No.: 870,554

[22] Filed: Nov. 7, 1969

[51] Int. Cl.[2] ..... F41G 7/00

[52] U.S. Cl. ..... 244/3.16

[58] Field of Search ..... 244/3.16, 3.13, 3.14, 244/3.11, 3.12

[56] References Cited

U.S. PATENT DOCUMENTS

| | | | |
|---|---|---|---|
| 2,930,894 | 3/1960 | Bozeman | 244/3.11 |
| 2,944,763 | 7/1960 | Grandgent et al. | 244/3.14 |
| 3,169,191 | 2/1965 | Knapp | 244/3.16 |
| 3,366,346 | 1/1968 | McKnight et al. | 244/3.11 |
| 3,372,889 | 3/1968 | Menke | 244/3.14 |

*Primary Examiner*—Samuel Feinberg

*Attorney, Agent, or Firm*—Nathan Edelberg; Robert P. Gibson; Harold W. Hilton

[57] ABSTRACT

An optical tracking link for a command guidance missile system employing dual frequency modulation of the optical signal transmitted from the missile beacon. Dual frequency encoding of the missile tracking beacon improves beacon-tracker performance in the presence of countermeasures or false signals. A solid state, missile beacon within the missile housing transmits alternate bursts of optical energy of first and second high frequencies during alternate half cycles of a low frequency modulating signal therefor. The optical, modulated signal is received by an optical tracker at the missile launch site, completing a link between the missile and the launch site. A visual tracker at the launch site provides line-of-sight contact with a target being tracked. A guidance control for the missile responds to output signals from the missile and visual tracker to develop an error signal between the longitudinal, line-of-sight axis and the missile trajectory. Any deviation of the missile from a course of impact with the target causes an error signal to be transmitted to the missile for flight course correction. The solid state beacon includes first and second clocks each having a high frequency output therefrom, which is modulated by a low frequency and coupled through a power driver to a GaAs diode array, which generates an optical signal in response to a square wave input signal. This alternately modulated signal is received by a detector preamplifier of the optical tracker. A diode array in the detector is activated by the impinging optical signal and generates an electrical signal in response to the input wave. This signal is filtered to retrieve the two high frequencies and demodulated to extract the lf modulating wave from each frequency. This low frequency is then combined in a differential amplifier and interfaced with error detection equipment for generating a command guidance signal to the missile for attitude control thereof.

9 Claims, 3 Drawing Figures

Walter E. Miller Jr.
Jimmy R. Duke
Robert L. Sitton,
INVENTORS.
BY Harry M. Saragovitz
Edward J. Kelly
Herbert Berl
Harold G. Hilton Walter E. Miller Jr.
Jimmy R. Duke
Robert L. Sitton,
INVENTORS.
BY Harry M. Saragovitz
Edward J. Kelly
Herbert Berl
Harold W. Dirks WALTER E. MILLER JR.
JIMMY R. DUKE
ROBERT L. SITTON,
INVENTORS.
BY Harry M. Saragovitz
Edward J. Kelly
Herbert Berl
Harold W. Hilton

MODULATED, DUAL FREQUENCY, OPTICAL TRACKING LINK FOR A COMMAND GUIDANCE MISSILE SYSTEM

BACKGROUND OF THE INVENTION

A coded optical beacon is currently being provided on automatic command to line-of-sight anti-tank guided missile systems, which provides a unique missile signature for automatic tracking and guidance. This signature should provide discrimination against normal background interference such as fires, horizon, glare, reflection, etc. and; discrimination against deliberate false targets such as flares, searchlights, and other optical jammers, however, these optical signatures provide a relatively low frequency signal output and as therefore susceptible to false targets (optical jammers) having frequencies in this low frequency range.

Jamming sources for optical beacons include Tungsten flare and Xenon arc lamps. These lamps are high average intensity jammers at relatively low frequencies. For example, the frequency response of the Xenon arc lamp is a function of lamp size and current. Increasing the lamp size and increasing input power level reduces the frequency response of the optical output of the lamp. Xenon and other relative low frequency jammers offer little significant countermeasures threat to a high frequency coded system. Typically, test results of a 75 watt Xenon arc lamp indicate that approximately 100 KHz can be construed to be a maximum boundary of relative effectiveness for Xenon jammers. Since these lamps and other similar optical jammers are less efficient at higher frequencies, operation of an optical beacon at a relatively high frequency is desirable when the high frequency exceeds the maximum effective boundry of the jammers. High frequency operation of missile beacons has been prohibitive in the past because of the physical characteristics of light emitting devices.

SUMMARY OF THE INVENTION

In a command guidance missile system, a dual frequency, optical tracking link provides an optical signal transmitted from a missile beacon to a beacon tracker which measures the deviation of missile flight with respect to a line-of-sight axis from the launch site to a target, for maintaining correct missile trajectory. The optical signal comprises two high frequencies transmitted alternately during alternate half cycles of a low frequency on-off modulation rate. This alternating rate of transmission employs pulse burst modulation (PBM) wherein a high frequency burst of energy is periodically transmitted. Thus a wave of optical energy is transmitted wherein a first high frequency is interspersed with bursts of a second high frequency at half cycle intervals of a low frequency. This signal is received by an optical tracker and reduced to extract the identical low frequency (but 180° out of phase) modulating wave from each high frequency. The low frequency waves are combined and connected to a guidance control circuit for controlling missile attitude.

An optical missile tracker, a visual target tracker and a guidance control unit are provided for the missile. When a target is selected, the gunner establishes a line-of-sight to the target and fires the missile, maintaining visual contact with the target, during flight, through a visual tracker. The visual target tracker can be a telescope coaxially aligned with the optical missile tracker. Since command guidance is controlled from the launch area, no lead or elevation requirements are necessary. Initially the launched missile may be guided (pitch, yaw and roll) by conventional on-board controls, as gyros. During flight the optical tracker instantly acquires the missile optical source, the gunner maintains visual tracking contact with the target and the guidance control set detects differences between the gunners line-of-sight and the missile direction, forwarding these signals to the missile to produce pitch and yaw corrections.

Solid state photoemissive diodes are employed as the missile beacons. One advantage of the solid state beacon over prior art beacons is the extended frequency capability, which allows accomplishment of countermeasures hardening by virtually eliminating low frequency interference in the missile control system. Optical rise time of the high power diodes permit operation in the megacycle range; however, due to other circuit limitations, operation is limited to a continuous wave upper limit of approximately 2 MHz. The use of diode beacons allows the bulk, weight, and power capabilities to be reduced, while providing an equivalent or stronger signal level at the tracker than that of prior art beacons. High frequency operation of the beacon places a penalty on Xenon arc, Tungsten flare and other similar jamming sources, opening the possibility of more sophisticated encoding techniques such as frequency modulation by pulse burst coding. Thus, discrimination against background interference from normal and false optical jammers is provided which is easily adaptable with existing missile guidance techniques.

An object of the present invention is to generate and encode a unique optical waveform on a command guided missile by solid state photodiodes and transmit the optical wave to the launch site.

Another object of the present invention is to detect the unique waveform from extraneous waves and process it as though it were a simultaneous amplitude modulation of two rf carriers.

A further object of the present invention is to provide a high frequency optical link in a missile control system to improve beacon-tracker performance in the presence of countermeasures or other false sources.

DESCRIPTION OF THE PREFERRED EMBODIMENT

Figure 1:
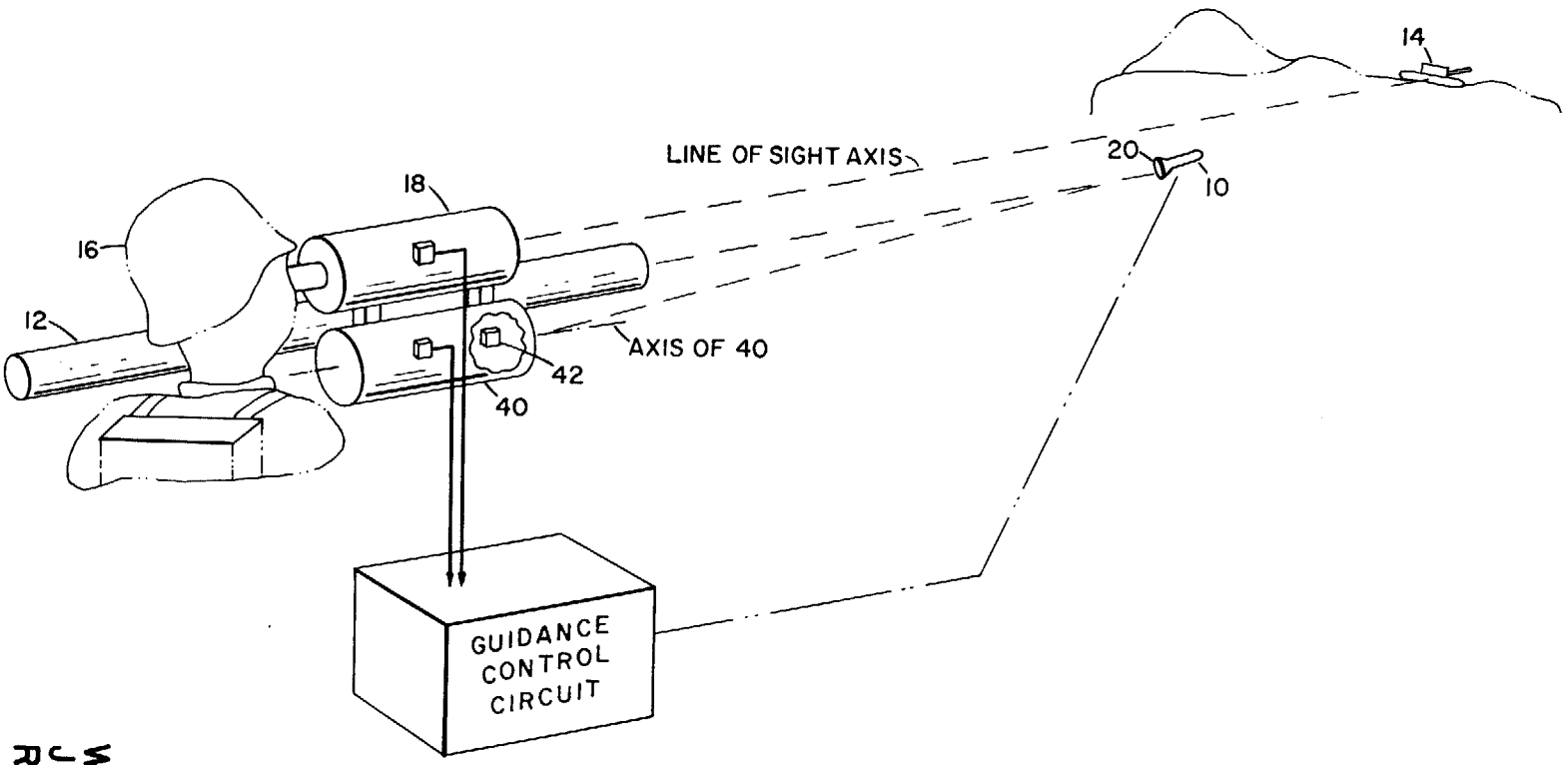
FIG. 1 is a perspective view of a command guided missile system having an optical tracking link between the missile and tracker.

Referring now to the drawings, wherein like numerals refer to like parts in each figure, FIG. 1 discloses a system diagram representing a preferred embodiment of the invention wherein a missile 10 is launched from a launching tube 12 toward a target 14. A guidance control for missile 10 may be provided by any convenient or desired means as has been used in the prior art, for example — radio frequency control or wire line control of pitch, yaw and roll. To provide missile guidance an observer 16, at or adjacent the launch site, establishes and maintains line-of-sight contact with target 14 through a visual tracker 18, which may be a telescope. On command, missile 10 seeks to align with the longitudinal axis of the visual tracker. Changing the direction of the longitudinal axis of tracker 18, as in tracking a moving target, results in a change in flight direction or trajectory of missile 10 as it attempts to realign with the axis of tracker 18. Therefore, maintaining aligned contact with target 14 ensures that the missile will intercept target 14 where the extended longitudinal axis of tracker 18 intercepts the target.

At missile launch, a photoemissive diode beacon 20 is activated in missile 10 and transmits an optical signal toward the launch site and optical tracker 40. The optical signal impinges on a filtered light sensitive detector 42 within optical tracker 40 and is converted to a high frequency electrical signal. The electrical signal is processed to produce a correctional signal representative of missile deviation from the longitudinal axis of tracker 40. This correctional or error signal indicates the direction and amount of correction necessary to align missile 10 with target 14.

Figure 2:
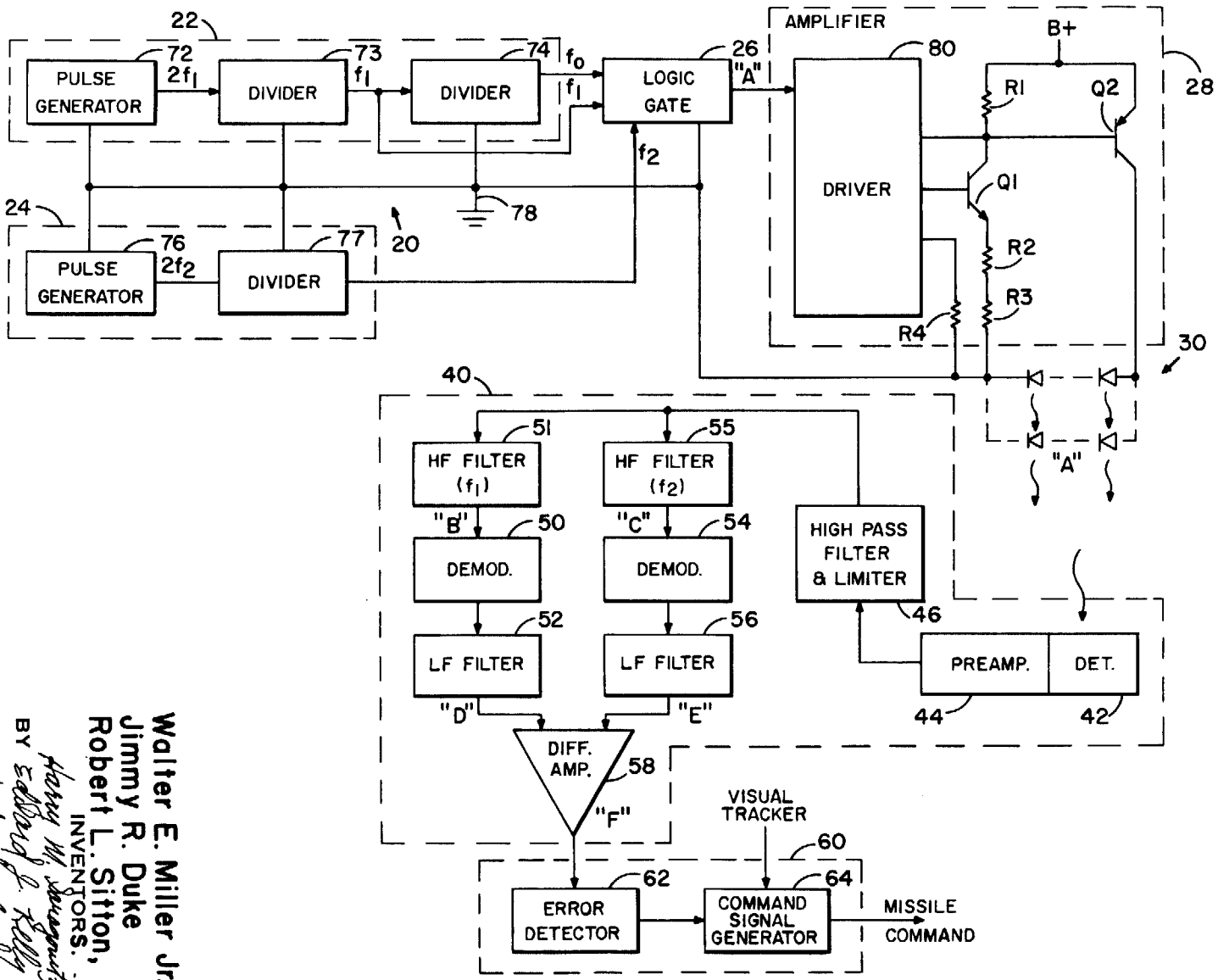
FIG. 2 is a partial schematic and block diagram of a missile beacon and beacon tracker employing the inventive concept.

In FIG. 2, system circuitry is shown in more detail. In beacon 20, a clock 22 comprises a crystal oscillator pulse generator 72, a divider circuit 73, and a divider circuit 74. An output of generator 72 is connected to an input of divider 73 and an output of divider 73 is connected to an input of divider 74. The output of divider 73 is also connected as a high frequency (*hf*) clock output $f_1$ and an output of divider 74 is connected as a low frequency (*lf*) clock output $f_0$. A clock 24 includes a pulse generator 76 having an output connected to a divider 77. Divider 77 has a high frequency clock output $f_2$. These clock output frequencies ($f_0$, $f_1$ and $f_2$) are connected as inputs to a logic gate circuit 26. An output of gate circuit 26 is connected as an input to a driver 80 of a power amplifier 28. Driver 80 has first and second outputs thereof connected respectively to the base and collector of NPN transistor Q1. The collector of Q1 is further connected to the base of a PNP transistor Q2, providing both current and voltage amplfication to drive a gallium-arsenide diode array 30. The emitter of Q2 and the collector of Q1 are connected to a positive power source and the collector of Q2 is connected to the anode side of photoemissive array 30. The emitter of Q1 is connected through a series connected pair of resistors R2 and R3 to the cathode side of array 30 and to a circuit ground 78 of beacon 20. A resistor R1 is connected as a load in the collector circuit of Q1 and a resistor R4 serves as a base biasing resistor for the driver output transistor (not shown), which is connected with Q1 as a Darlington amplifier.

Photosensitive detector 42 of optical tracker 40 is interconnected with a preamplifier 44. An output of amplifier 44 is connected to an input of a filter and limiter circuit 46. An output of filter and limiter circuit 46 is connected as an input to first and second hf demodulator channels. A first demodulator 50 has an input connected to the output of a hf filter 51 and an output connected to a lf filter 52. A second demodulator 54 is connected similarly to a hf filter 55 and a lf filter 56. The output of high pass filter circuit 46 is thus, connected as an input to filters 51 and 55. The outputs of filters 52 and 56 are connected as inputs to a differential amplifier 58. Differential amplifier 58 has an output connected to an error detector circuit 62 of guidance control circuit 60, which stimulates the generation of a command signal to the missile by command signal generator 64.

Figure 3:
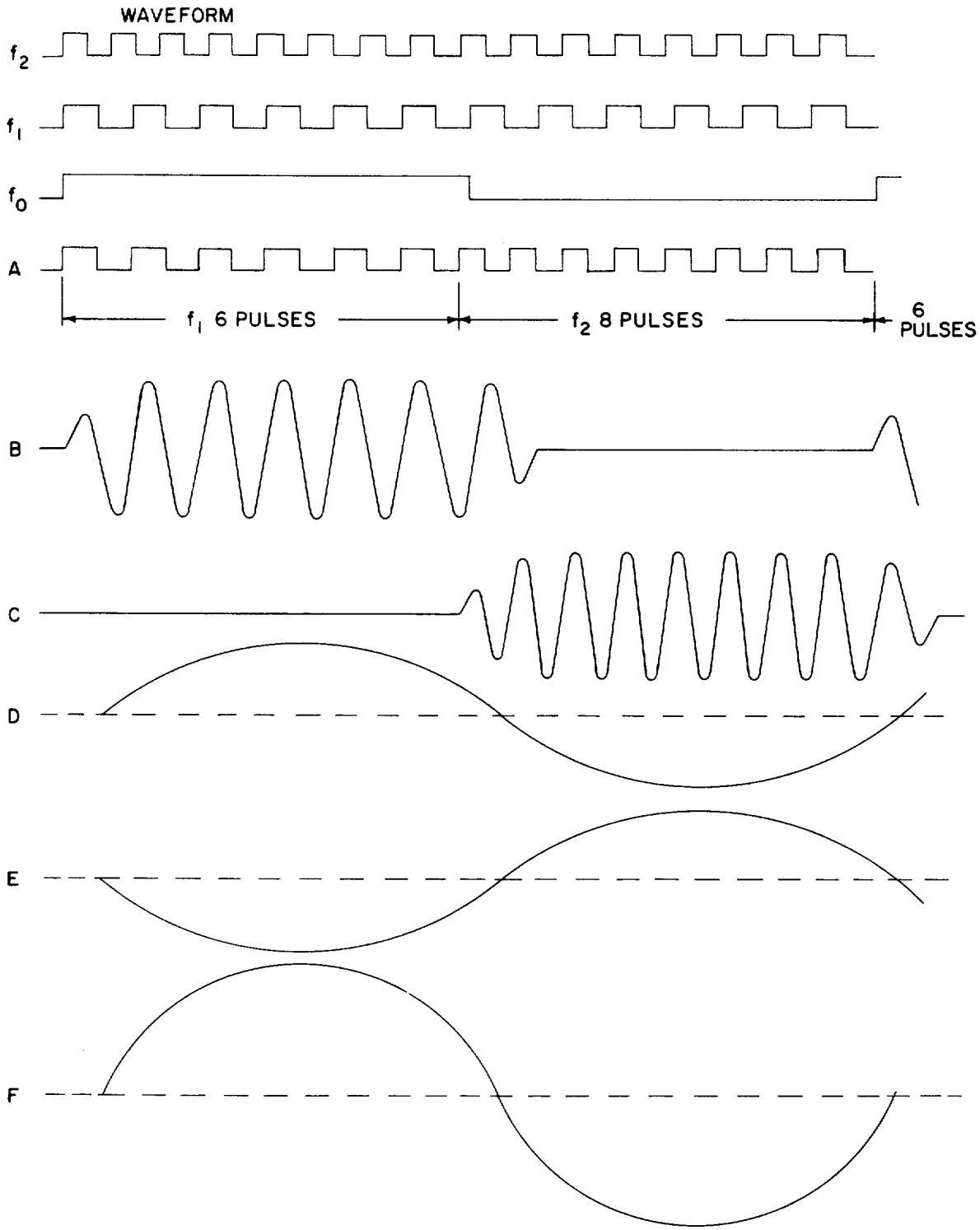
FIG. 3 is a time sequence diagram of the waveforms at various locations in the modulator and demodulator.

The optical beacon and first stages of a beacon tracker of FIG. 3 have been constructed and operated to perform the functions indicated in FIG. 1, with the following shelf items or equivalents thereto:

| | |
|---|---|
| Clock (22, 24) | |
| Pulse generator (72, 76) | Crystal controlled oscillator |
| Divider circuit (73, 77) | Motorola model No. MC848P |
| Divider circuit 74 | Motorola model No. MC839P |
| Logic Gate 26 | Motorola model No. MC862G |
| Amplifier Driver 80 | Motorola model No. MC943G |
| Amplifier Output Stage: | |
| Q1 | 2N2222A |
| Q2 | 2N1908 |
| R1 | 2,400 ohms |
| R2 | 56 ohms |
| R3 | 26 ohms |
| R4 | 12,000 ohms |
| Photoemissive diodes 30 | TI OSX 1209 |
| Detector 42 | SGD - 100 |
| Preamplifier 44 | HP 462A |
| Filter 46 | Kronhite model 310 |
| Filter (51, 55) | Kronhite model 310 |
| Demodulator (50, 54) | Diode rectifiers |
| Filter (52, 56) | Kronhite model 310 |
| Differential Amplifier | Oscilloscope Differential input |

In operation, pulse generator 72 generates a hf waveform $2f_1$ which is reduced by divider 73 to high frequency $f_1$. Divider 73, a divide-by-two circuit, has the $f_1$ output thereof connected as an input to divider 74 and as an input to logic gate 26. Divider 74 responds to $f_1$ and provides low frequency $f_o$ as an output. These output frequencies, $f_O$ and $f_1$, are outputs of clock 22 and are two of the input signals of gate 26. Clock 24 has an output $f_2$ which is a third input to gate 26. In producing $f_2$, pulse generator 76 has a high frequency output $2f_2$ that is divided by divider circuit 77.

Logic gate 26 responds to $f_0$, $f_1$ and $f_2$ by providing an output signal whenever $f_0$ and $f_1$ are logic one and also when $f_0$ is logic zero and $f_2$ is logic one, thus resulting in alternating bursts of $f_1$ and $f_2$ at a rate of $f_0$. FIG. 3 discloses these waveforms. The particular letter reference ($f_2$, $f_1$, $f_0$, A, etc.) associated with each waveform is also noted in FIG. 2, indicating the presence of that waveform where noted. Waveform A shows alternate pulse bursts of $f_1$ and $f_2$ during alternate half cycle intervals of $f_0$. Thus gate 26 has an output A wherein two high frequencies are transmitted at equal alternate intervals of a lower frequency. Amplifier driver 80 receives the modulated carrier and provides both current and voltage amplfication as required to drive diode array 30. The optical output waveform of diode array 30 is waveform A, resulting in alternate optical pulse bursts of 6 pulses of $f_1$, then 8 pulses of $f_2$ for the particular example as shown in FIG. 3.

The rearwardly transmitted optical energy impinges on detector 42 of tracker 40 and is converted back to a high frequency electrical signal, and amplified by preamplifier 44. The detector/preamplifier must have a sufficient bandwidth to pass the broad FM signal (A) without passing dc components. The signal is then coupled to high pass filter and limiter 46, which aids counter-countermeasures by penalizing or blocking Xenon and related lower frequency jamming sources. The limiter clips high peak power pulses to prevent ringing thereby of bandpass filters 51 and 55. The signal is then fed to two parallel pulse burst modulation processing units or channels.

In the PBM processing units, filter 51, a bandpass filter tuned to $f_1$, passes only the component of wave A that is representative of $f_1$ and its first sidebands. Thus, filter 51 is only responsive to the input signal during alternate half cycles of the modulation rate $f_0$ and passes the waveform B of FIG. 3. Waveform B is rectified in demodulator 50 and filtered in 1/f filter 52 to pass the resulting tone frequency D, a sinusoidal replica of $f_0$, to a first input of differential amplifier 58. Similarly, filter 55 is tuned to $f_2$ and its first sidebands and passes only that portion of the input signal, which is further demodulated and filtered by demodulator 54 and 56. Waveforms C and E represent the alternating current components respectively of $f_2$ and $f_0$, with waveform E being applied to a second input of differential amplifier 58.

With the FM waveform incident upon the two channels, as has already been noted, one of the carrier frequencies is on, when the other is off. This produces high frequency bursts, as shown in waveforms B and C, out of the respective hf bandpass filters. Demodulation and filtering of these bursts produce the sine waves of waveforms D and E, which are exactly 180° out of phase. These two sine waves actually produce a single reenforcing wave when amplified by differential amplifier 58, which produces output waveform F.

All the advantages of pulse burst modulation are thus employed to prevent signal or pulse jamming by false signals. Additionally, in the event that a jamming signal is received by optical tracker 40 and is able to ring the bandpass filters in spite of the action of limiter 46, and assuming that the ringing occurs and stops at such a frequency that the demodulated envelope of the ring will be passed by the tone filters, these jamming signals will be in phase and the common mode rejection capability of the differential amplifier will permit this signal to be ignored. This allows only the difference in the two differential input signals D and E to be amplified, which is the desired beacon signature. Thus considerable countermeasure rejection capability is allowable. The common mode rejection capability of a typical operational amplifier is on the order of 75 to 85 db.

A typical logic gate that can perform the function of gate 26 is described herein below, for example. First and second NAND gates have inverted high outputs connected to a third NAND gate. The inputs to the first NAND gate include $f_1$ and $f_0$. The inputs to the second NAND gate are $f_2$ and inverted $f_0$. The output of the third NAND gate is connected to the power driver.

The frequency $f_0$, indicated as a tone frequency, is not necessarily limited thereto and may vary from the high frequency level by any amount desired, but is typically less than 1/5 th of the high frequency. For example, assuming high frequency $f_1 = 180$ KHz, $f_0$ may be 1/30th thereof or 6 KHz. This 6 KHz tone then establishes the first sidebands of the 180 KHz carrier at 186 KHz and 174 KHz. The second carrier, then, may be any frequency that will permit bandpass filters to separate the two modulated carriers and their sidebands. Assuming a high frequency $f_2 = 150$ KHz, the first sidebands thereof are at 144 and 156 KHz. Utilizing tone frequencies for $f_0$ allows the optical tracking link to be compatable with present missile guidance systems with only minor alterations.

We claim:

1. A dual frequency, optical tracking link within a missile tracking system, comprising: a photoemissive beacon within a missile housing to be tracked for transmitting an optical coded signal; said beacon including square wave generating means for producing a plurality of distinct and separate electrical square wave output frequencies, light emitting means, and coupling means for connecting said square wave frequencies to said light emitting means; optically sensitive tracking means, including photosensitive detectors responsive to said coded signal for providing an electrical signal output indicative of said coded signal, a preamplifier responsive to said detector for amplifying said electrical signal output, and means for reducing said plurality of frequencies for providing attitude control signals to said missile.

2. An optical tracking link as set forth in claim 1 wherein said square wave generating means includes first and second clocks for producing first and second high frequency square wave outputs, and said first clock further producing a third square wave; and further comprising means for modulating said first and second square wave frequencies with said third frequency.

3. An optical tracking link as set forth in claim 2 wherein said modulating means is a logic gate circuit responsive to said high frequencies and said third frequency to develop an output signal wherein alternate bursts of said first and second high frequencies are modulated or gated at alternate intervals of said third frequency for providing a continuous output signal, and said light emissive means is photoemissive solid state diodes.

4. An optical tracking link as set forth in claim 3 wherein said coupling means is a power driver for amplifying said gated output signal, and said photoemissive diodes are gallium-arsenide diodes responsive to said amplified, gated signal to generate an optical signal equivalent to said alternating bursts of said first and second high frequencies.

5. An optical tracking link as set forth in claim 4 wherein said frequency reducing means include: first and second demodulator channels each having a demodulator connected between a hf bandpass filter and a lf bandpass or notch filter, a high pass filter and limiter connected between said preamplifier and an input of each of said hf channel filters, and a differential amplifier responsive to the lf filter outputs of said first and second channels to provide differential amplification and common mode rejection, said first low frequency filter output being 180° out of phase with respect to said second lf filter output.

6. An optical tracking link as set forth in claim 5 wherein said third frequency is a square wave tone frequency and a sub-multiple of said first high frequency, and said photosensitive detectors are solid state diode detectors.

7. A method for providing a frequency modulated high frequency optical tracking link between a missile and a relatively fixed tracking station, said tracking station being disposed for distinguishing said target and maintaining said missile in a trajectory terminating at said target, comprising the steps of:

a. maintaining said target in a line-of-sight relationship with an observer,
b. directing a continuous output signal of high frequency bursts of optical energy at alternate intervals of a low frequency modulation rate rearwardly from said missile during traversal of said trajectory,
c. receiving and detecting said continuous signal of optical energy,
d. reducing said high frequency signal and obtaining the low frequency modulation waveform therefrom, and
e. generating attitude response in a missile proportionate to relative displacement between the missile and said line-of-sight for retention of said missile in said trajectory.

8. A method for providing an optical tracking link as set forth in claim 7, further comprising the steps of:

a. generating first and second high frequency square waves and a low frequency square wave within said missile b. alternately modulating said high frequency waves at alternate intervals of said low frequency wave rate and applying the resulting continuous signal of alternating bursts of energy to a driver amplifier, and e. applying a driver amplifier output signal to a gallium-arsenide diode array for stimulating transmission of said continuous signal of optical energy from said missile by said diode array.

9. A method for providing an optical tracking link as set forth in claim 8, further comprising the steps of:

a. detecting said optical energy burst by a diode detector array of said tracker and producing an electrical high frequency signal in response thereto, b. applying the detected high frequency signal to a filter and limiter for elimination of unwanted frequencies, c. applying a filter and limiter output signal to first and second demodulator channels for separating said first and second high frequency signals therefrom, and obtaining the low frequency modulation therefrom, d. passing said low frequency signals through respective first and second low frequency filters to eliminate unwanted signals from said low frequency modulation waveform for each channel, e. applying said low frequency waveforms to a differential amplifier with said first channel output being 180° out of phase with the second channel, and f. applying the low frequency waveform, differential amplifier output to an error detection circuit for determining said directional correction signals by conventional means.

* * * * *